US010752860B2

(12) United States Patent
Greaves et al.

(10) Patent No.: US 10,752,860 B2
(45) Date of Patent: Aug. 25, 2020

(54) LUBRICANT COMPOSITION

(71) Applicant: Dow Global Technologies LLC, Midland, MI (US)

(72) Inventors: Martin R. Greaves, Baar (CH); Evelyn A. Zaugg-Hoozemans, Richterswil (CH)

(73) Assignee: Dow Global Technologies LLC, Midland, MI (US)

( * ) Notice: Subject to any disclaimer, the term of this patent is extended or adjusted under 35 U.S.C. 154(b) by 0 days.

(21) Appl. No.: 16/310,288

(22) PCT Filed: Jun. 21, 2017

(86) PCT No.: PCT/US2017/038495
§ 371 (c)(1),
(2) Date: Dec. 14, 2018

(87) PCT Pub. No.: WO2017/223174
PCT Pub. Date: Dec. 28, 2017

(65) Prior Publication Data

US 2019/0127660 A1 May 2, 2019

Related U.S. Application Data

(60) Provisional application No. 62/354,296, filed on Jun. 24, 2016.

(51) Int. Cl.

| | |
|---|---|
| ***C10M 169/04*** | (2006.01) |
| ***C10M 161/00*** | (2006.01) |
| ***C10M 101/00*** | (2006.01) |
| ***C10M 107/24*** | (2006.01) |
| ***C10M 133/12*** | (2006.01) |
| ***C10M 151/04*** | (2006.01) |
| *C10N 30/08* | (2006.01) |
| *C10N 30/10* | (2006.01) |
| *C10N 40/04* | (2006.01) |
| *C10N 40/08* | (2006.01) |
| *C10N 40/25* | (2006.01) |
| *C10N 40/30* | (2006.01) |
| *C10N 50/10* | (2006.01) |

(52) U.S. Cl.
CPC ..... *C10M 169/044* (2013.01); *C10M 101/00* (2013.01); *C10M 107/24* (2013.01); *C10M 133/12* (2013.01); *C10M 151/04* (2013.01); *C10M 161/00* (2013.01); *C10M 2203/003* (2013.01); *C10M 2203/1025* (2013.01); *C10M 2205/0285* (2013.01); *C10M 2205/223* (2013.01); *C10M 2209/043* (2013.01); *C10M 2215/064* (2013.01); *C10M 2215/26* (2013.01); *C10M 2221/043* (2013.01); *C10N 2030/08* (2013.01); *C10N 2030/10* (2013.01); *C10N 2040/04* (2013.01); *C10N 2040/08* (2013.01); *C10N 2040/25* (2013.01); *C10N 2040/30* (2013.01); *C10N 2050/10* (2013.01)

(58) Field of Classification Search
CPC ..... C10M 169/044; C10M 161/00; C10M 101/00; C10M 107/24; C10M 133/12; C10M 151/04; C10M 2221/043; C10M 2203/1025; C10M 2215/064; C10M 2205/0285; C10M 2205/223; C10M 2203/003; C10M 2209/043; C10M 2215/26; C10N 2230/10; C10N 2240/04; C10N 2240/08; C10N 2240/10; C10N 2230/08; C10N 2240/30; C10N 2250/10
See application file for complete search history.

(56) References Cited

U.S. PATENT DOCUMENTS

| | | | | |
|---|---|---|---|---|
| 3,005,853 | A | 10/1961 | Wilgus et al. | |
| 3,135,804 | A * | 6/1964 | Von Brachel | C08G 65/34 568/45 |
| 4,769,164 | A * | 9/1988 | Salomon | C10M 141/08 252/406 |
| 4,894,174 | A | 1/1990 | Salomon | |
| 5,856,280 | A | 1/1999 | Kim et al. | |
| 5,994,277 | A | 11/1999 | Ritchie et al. | |
| 6,806,241 | B2 | 10/2004 | Karol et al. | |
| 7,494,960 | B2 | 2/2009 | Migdal et al. | |
| 8,093,190 | B2 | 1/2012 | Chase et al. | |
| 8,901,060 | B2 | 12/2014 | Fasbender | |
| 2014/0045736 | A1 | 2/2014 | Crawley et al. | |
| 2014/0213493 | A1 | 7/2014 | Chase et al. | |

FOREIGN PATENT DOCUMENTS

| | | |
|---|---|---|
| EP | 0896050 | 2/1999 |
| WO | 88/09366 | 12/1988 |
| WO | 2017031162 | 2/2017 |

OTHER PUBLICATIONS

Nternational Preliminary Report on Patentability for related PCT Application PCT/US2017/038495, dated Jan. 3, 2019 (9 pgs).
International Search Report & Written Opinion for related PCT Application PCT/US2017/038495, dated Sep. 22, 2017 (13 pgs).

* cited by examiner

*Primary Examiner* — Cephia D Toomer
(74) *Attorney, Agent, or Firm* — Brooks, Cameron & Huebsch, PLLC

(57) ABSTRACT

An antioxidant package composition including a combination of: (i) at least one aromatic amine, and (ii) at least one polyether sulphide; a lubricant composition including: (a) the above antioxidant package and (b) at least one base oil; a process for preparing the antioxidant package; and a process for preparing the lubricant composition.

19 Claims, No Drawings

LUBRICANT COMPOSITION

This application is a National Stage Application under 35 U.S.C. § 371 of International Application Number PCT/US2017/038495, filed Jun. 21, 2017 and published as WO 2017/223174 on Dec. 28, 2017, which claims the benefit to U.S. Provisional Application 62/354,296, filed Jun. 24, 2016, the entire contents of which are incorporated herein by reference in its entirety.

FIELD

The present invention is related to lubricant compositions comprising a base oil which contains an alkylated diphenylamine anti-oxidant and a polyether sulphide. More specifically, the present invention relates to lubricant compositions that include a polyether sulphide (S-PAG) which can boost the anti-oxidant performance of the alkylated diphenylamine present in the lubricant composition.

BACKGROUND

Most industrial and automotive lubricants contain an anti-oxidant or a combination of anti-oxidants to extend the lubricants' useful operating life. In some applications, such as automotive engine oils, there is a need for lubricants to perform under high thermal stresses where the lubricant can experience temperatures of for example 250 degrees Celsius (° C.) or higher. In addition, lubricants having longer drain intervals are desired. Currently for example, oil drain intervals for passenger cars using current motor oils require a drain interval every 3 to 4 months over the life time of the automobile. One potential technical solution to extending the life or oil drain intervals of a lubricant is to develop new anti-oxidants useful in lubricants or to develop combination of current commercial anti-oxidants with other materials that provide a synergistic performance in extending oil drain intervals.

Heretofore, the most common types of anti-oxidants used in lubricants are alkylated diphenylamines (ADPA). Another type of anti-oxidants used in lubricants is hindered phenolic anti-oxidants. Both of these types of anti-oxidants are often described as "free radical scavengers". A second class of anti-oxidants is a "peroxide decomposer". This second class of anti-oxidants' mode of action is very different to the free radical scavengers. The action of the peroxide decomposers is to reduce the alkyl hydroperoxides to alcohols. These hydroperoxides form from the radical decomposition of the lubricant base oil. In this way peroxide decomposers are consumed in a sacrificial manner. Conventional peroxide decomposers include sulphur-containing organometallic materials such as molybdenum dialkyldithiocarbamates (MoDTC) and zinc dialkyldithiophosphates (ZDDP).

Other antioxidants for use in lubricant compositions have been disclosed heretofore. For example, U.S. Patent Application Publication No. 2014 0213,493 A1 discloses an ashless lubricant composition containing a metal-free sulfur-containing compound including an ashless dithiocarbamate, such as methylene bis(dibutyldithiocarbamate), and sulfurized fatty acids. U.S. Patent Application Publication No. 2014/0045736 A1 discloses lubricating compositions for turbine and hydraulic systems containing an ashless dithiocarbamate anti-wear agent. U.S. Pat. No. 8,093,190 discloses a lubricant anti-oxidant composition containing a metal compound (e.g. molybdenum, tungsten, titanium or boron) and a hindered amine. U.S. Pat. No. 5,994,277 discloses lubricating compositions including copper, a Mo-based compound, an aromatic amine, and a ZDDP. U.S. Pat. No. 6,806,241 B2 discloses lubricating compositions containing an antioxidant additive composition that includes a sulfur compound selected from the group consisting of: (a) thiadiazole; (b) dithiocarbamate; and (c) mixtures thereof. European Patent No. EP 0896 050 A1 discloses lubricant oil compositions including sulphur-based organics such as diester sulphides (e.g. dialkylthioproprionate) as oxidation inhibitors.

SUMMARY

The present invention is directed to an effective antioxidant package for a lubricant composition wherein the antioxidant package provides a synergistic performance in extending the life of a lubricant. For example, in one embodiment, the antioxidant package of the present invention includes a combination of (i) an alkylated diphenylamine anti-oxidant, and (ii) a polyether sulphide. In another embodiment, the present invention is directed to a lubricant composition containing the above antioxidant package.

In still another embodiment of the present invention is directed to a lubricant composition including: (a) a base oil, (b) an alkylated diphenylamine anti-oxidant, and (c) a polyether sulphide. The polyether sulphide (S-PAG) useful in the lubricant of the present invention provides a boost to the anti-oxidant performance of the alkylated diphenylamine present in the lubricant of the present invention.

Other embodiments of the present invention include a process for preparing the antioxidant package; a process for preparing the lubricant composition containing the antioxidant package; and a process for using the lubricant composition or formulation as an automotive engine oil.

DETAILED DESCRIPTION

"Base oils" herein means oils that include both natural oils and synthetic oils. Natural and synthetic oils can be used in the present invention unrefined, refined, or re-refined. The American Petroleum Institute (API) has defined/classified base oils into several categories ("Groups") such as Groups I, II, III, IV and V to create guidelines for lubricant base oils. Group I base stocks generally have a viscosity index of greater than or equal to (≥) 80 to less than (<)120 and contain greater than (>) 0.03 percent (%) sulfur and <90% saturates. Group II base stocks generally have a viscosity index of ≥80 to less than <120, and contain less than or equal to (≤)0.03% sulfur and ≥90% saturates. Group Ill base oils generally have a viscosity index ≥120 and contain ≤0.03% sulfur and ≥90% saturates. ASTM D2270 is used to calculate viscosity index. Group IV base oils include polvalphaolefins (PAO). Group V base stocks include base stocks not included in Groups I-IV. For example, Group V base oils may include polyalkylene glycols, synthetic esters, polyisobutylenes, phosphate esters, and the like. The following table summarizes properties of each of the aforementioned five Groups of base oils.

| | Base Oil Properties | | |
|---|---|---|---|
| | Saturates | Sulfur | Viscosity Index |
| Group I | <90 and/or | >0.03% and | ≥80 and <120 |
| Group II | ≥90 and | ≤0.03% and | ≥80 and <120 |
| Group III | ≥90 and | ≤0.03% and | ≥120 |
| Group IV | Includes polyalphaolefins (PAO) | | |
| Group V | All other base oil stocks not included in Groups I, II, III or IV | | |

An "antioxidant" herein means a component that assists in reducing the rate of oxidation of a base oil or a lubricant composition.

A "useful operating life", with reference to a lubricant, herein means a lubricant having the desired functionality to be successfully used in equipment for a desired period of time.

An "antioxidant package" herein means a mixture of two or more components of which at least one component is an anti-oxidant. Other components useful in the antioxidant package may include, for example, one or more of the following compounds or additives: other anti-oxidants, corrosion inhibitors, viscosity modifiers, detergents, anti-wear agents, extreme pressure additives and solvents that aid in maintaining the package homogenous during storage and handling.

One broad embodiment of the present invention includes an antioxidant package useful as an antioxidant agent for a lubricating oil. For example, the antioxidant package includes a combination of: (i) at least one alkylated diphenylamine antioxidant, and (ii) at least one polyether sulphide.

In preparing the antioxidant package of the present invention, a first required component (i) includes at least one alkylated diphenylamine (ADPA) anti-oxidant compound. The chemical structure of an ADPA is shown in the formula of Structure (I) as follows:

Structure (I)

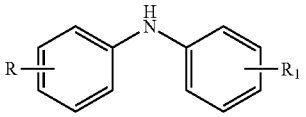

wherein R is an alkyl radical containing 1 to 20 carbons, and wherein $R_1$ is an alkyl radical containing 1 to 20 carbons. R and $R_1$ can be the same or different in Structure (I).

The at least one ADPA antioxidant, component (i), of the present invention can include any conventional ADPA anti-oxidant compound within the scope of Structure (I) above. For example, the ADPA anti-oxidant of Structure (I) may include those compounds in which each R and R1, individually and separately, are C1 to C20. Commercially available products which have the Structure (I) and which are useful in the present invention may include for example, a compound of Structure (I) wherein each R and $R_1$ are both C8, and wherein each R and $R_1$ are both C9. For example, the commercial product Vanlube 81, available from RT Vanderbilt, is p,p'-dioctylated diphenylamine; and the commercial product Naugalube 438L, available from Chemtura, is dinonylated diphenylamine, both which fall within the scope of Structure (I).

In a preferred embodiment, the ADPA antioxidant can be a compound wherein R is butyl and wherein $R_1$ is octyl such as for example, Irganox L57 (R=butyl and $R_1$=octyl), an octylated/butylated diphenylamine commercial anti-oxidant product available from BASF.

The concentration of the ADPA antioxidant, component (i), present in the antioxidant package of the present invention may range generally from about 1 weight percent (wt %) to about 99 wt % in one embodiment, and from about 5 wt % to about 50 wt % in another embodiment, and from about 10 wt % to about 20 wt % in still another embodiment, based on the total weight of the components in the antioxidant package.

The ADPA antioxidant, component (i), provides the anti-oxidant package of the present invention with several benefit(s) including, for example, the functionality of the ADPA to act as an anti-oxidant, to improve the thermo-oxidative stability of the base oil, and to extend the base oil's useful operating life by extending oil drain intervals.

In preparing the antioxidant package of the present invention, a second required component (ii) includes at least one polyether sulphide compound.

The at least one polyether sulphide compound, component (ii), of the present invention can be any conventional polyether sulphide compound. For instance, general examples of component (ii) may include one or more of polyethers containing a sulphur group; disulphides; sulphur compounds having a sulphur group in oxidation state II, IV or VI; and mixtures thereof. In one preferred embodiment, the sulphur compound is a compound having a sulphur group in oxidation state II. When polymers have sulphur groups in oxidation state IV, the polymers are known as polyether sulphoxides and the sulphur is bonded to an oxygen atom and two carbons atoms from the polyether fragments. When polymers have sulphur in oxidation state VI, the polymers are known as polyether sulphones and the sulphur is bonded to two oxygen atoms and two carbon atoms from the polyether fragments. Polyether sulphoxides and polyether sulphones can function as anti-oxidant boosters for ADPAs In a preferred embodiment, specific examples of the polyether sulphide compound, component (ii), can be for example one or more S-PAGs which are a broad class of polyethers containing sulphur. For example, in one embodiment, the S-PAGs useful as component (ii) are alkoxylates of thiodiglycol also known as bis(2-hydroxyethyl) sulphide, and 2,2'-thiodiethanol, and mixtures thereof. Other bis(2-hydroxyalkyl) sulphides useful in the present invention may include for example bis(2-hydroxypropyl) sulphide, bis(2-hydroxybutyl) sulphide, bis(2-hydroxypentyl) sulphide, and mixtures thereof. In still another embodiment, the polyether sulphide compound may also include disulphides such as for example dithiodiglycol and mixtures of disulphides.

The concentration of the polyether sulphide compound, component (ii), in the antioxidant package of the present invention may range generally from about 1 wt % to about 99 wt % in one embodiment, from about 50 wt % to about 99 wt % in another embodiment, from about 10 wt % to about 50 wt % in another embodiment and from about 90 wt % to about 98 wt % in still another embodiment, based on the total weight of the components in the antioxidant package.

The polyether sulphide compound, component (ii), provides the antioxidant package of the present invention with several benefit(s) including, for example, the functionality of the polyether sulphide to act as an anti-oxidant booster to the ADPA. It can also improve the detergency properties of the lubricant. The polyether sulphide is a low-viscosity oil and can also improve handling of the antioxidant package. Typically, the viscosity of the polyether sulphide can be from about 30 centistokes (cSt) to about 500 cSt when measured using ASTM D445 (2015) at 40° C. The antioxidant package of the present invention may also include various other components, adjuvants, or additives including for example one or more of corrosion inhibitors, viscosity modifiers, emulsifiers, demulsifiers, dispersants, detergents, anti-wear additives, lubricity additives and extreme pressure additives, and mixtures thereof. The anti-oxidant package may also contain a solvent such as a mineral oil, glycol ether, ester, polyalkylene glycol, and mixtures thereof to improve ease of handling the anti-oxidant package.

The concentration of the optional additives added to the antioxidant package of the present invention may range generally from 0 wt % to about 95 wt % in one embodiment, from about 0.01 wt % to about 50 wt % in another embodiment, and from about 0.1 wt % to about 20 wt % in still another embodiment, based on the total weight of the components in the antioxidant package.

The optional additives, component (iii), may be added to the antioxidant package to provide the antioxidant package with the function of said additives and several benefit(s). For example, corrosion inhibitors will provide ferrous and non-ferrous corrosion inhibition functionality of the final lubricant composition to which the additive package is added. Viscosity modifiers can improve the viscosity index of the final lubricant composition to which the additive package is added. Solvents can improve low temperature properties of the anti-package and the final lubricant composition to which the additive package is added. Demulsifiers can improve the demulsification of the final lubricant composition to which the additive package is added. Antiwear and extreme pressure additives can improve the antiwear and extreme pressure properties of the final lubricant composition to which the additive package is added. Lubricity additives can improve the friction control properties of the final lubricant composition to which the additive package is added.

In a broad embodiment, the process of preparing the antioxidant package of the present invention includes blending or mixing the above components (i) to (iii) together to form the antioxidant package.

The process and type of equipment used to prepare the antioxidant package of the present invention includes blending or mixing of the above components in conventional mixing equipment or vessels known in the art. For example, the preparation of the antioxidant package of the present invention is achieved by blending, in known mixing equipment, components (i) and (ii) and optionally (iii) any other desirable additives. The preparation of the antioxidant package of the present invention, and/or any of the steps thereof, may be a batch or a continuous process.

All the above compounds of the antioxidant package are typically mixed and dispersed in a vessel at a temperature enabling the preparation of an effective antioxidant package. For example, the temperature during the mixing of the above components may be generally from about 20° C. to about 80° C. in one embodiment and from about 25° C. to about 50° C. in another embodiment.

In one preferred embodiment, the process of preparing an antioxidant package of the present invention includes, for example, the steps of: (a) loading a vessel with polyether sulphide; (b) adding ADPA to the vessel to form a mixture in the vessel; (c) stirring the mixture at from about 25° C. to about 50° C. for about 15 minutes (min) until the mixture in the vessel is homogeneous; and (d) allowing the resulting homogeneous mixture to cool to room temperature (about 23-25° C.).

Optionally, after step (c) above, one or more of the optional additives described above may be added to the mixture in the vessel. The mixture is then stirred further for about 30 min at from about 25° C. to about 80° C. until the mixture in the vessel is clear and homogeneous to the visual eye.

The antioxidant package of the present invention prepared by the above process exhibits several unexpected and unique properties; and imparts several improvements to the lubricant composition. One of the main important properties of the antioxidant package is to provide anti-oxidancy to the lubricant composition. Other properties exhibited by the antioxidant package can include for example lubricity, solvency, detergency, demulsification or emulsification, antiwear, and extreme pressure performance properties.

Generally, the antioxidant capability property of the antioxidant package can be measured versus a control sample that contains the same treat level of ADPA but does not contain a polyether sulphide. The method used to measure anti-oxidant performance in a modified ASTM D2893 (Method B). In this test the modifications are such that the time of the test is extended and samples of the fluid are taken after 3, 7, 13, 20, 27, 34, 41 and 48 days and their total acid numbers (TAN) are measured using ASTM D664-11. When the TAN value has risen by 2.0 mg KOH/g above its initial value the fluid has reached its end point and the time recorded. A further method to measure anti-oxidant performance is a modified ASTM D943 test. In this modified test the lubricant is aged under dry conditions (no water) in an oxygen atmosphere. The end point of the modified test is the time taken for the sample to reach 2 mg KOH/g above its initial starting value by measuring the total acid numbers using ASTM D664-11 about every 7 days during aging.

Another beneficial property of the antioxidant package of the present invention is its capability of providing the lubricant composition with an extended operating life. The life of the lubricant can be extended by the antioxidant package. The extended life of the lubricant composition can be correlated to the increase (as a percentage) of the thermo-oxidative stability property of the lubricant composition containing at least one polyether sulphide compared to a lubricant composition without containing the at least one polyether sulphide. The percent increase of the thermo-oxidative stability property of a lubricant composition of the present invention can be about 25% or greater in one embodiment, about 50% or greater in another embodiment, about 100% or greater in still another embodiment, and about 1,000% or greater in yet another embodiment. Alternatively, the percent increase of the thermo-oxidative stability property of the lubricant composition of the present invention can be in the range of from about 25% to about 1,000% in one embodiment and from about 50% to about 100% in another embodiment. The life of the lubricant provided by the antioxidant package can be determined using the procedure as described in a modified version of ASTM D2893B which is described herein below.

One broad embodiment of the present invention includes a lubricant composition useful as a lubricating oil for applications such as automobile oils. For example, the lubricant composition includes in combination: (a) the antioxidant package of the present invention described above which comprises (i) at least one alkylated diphenylamine antioxidant, and (ii) at least one polyether sulphide; and (b) at least one base oil.

In preparing the lubricant composition of the present invention, a first required component (a) includes the antioxidant package of the present invention described above which comprises (i) at least one alkylated diphenylamine antioxidant, and (ii) at least one polyether sulphide.

The concentration of the antioxidant package, component (a), in the lubricant composition of the present invention may range generally from about 0.1 wt % to about 50 wt % in one embodiment, and from about 0.5 wt % to about 25 wt % in another embodiment, and from about 1 wt % to about 10 wt % in still another embodiment, based on the total weight of the components in the lubricant composition.

In a preferred embodiment, the ADPA anti-oxidant can be present in the lubricant composition at a concentration of from about 0.05 wt % to about 10 wt % in one embodiment and from about 0.5 wt % to about 5 wt % in another embodiment, based on the total weight of the components in the lubricant composition.

In a preferred embodiment, the S-PAG can be present in the lubricant composition at a concentration of from about 0.1 wt % to about 25% in one embodiment and from about 0.25 wt % to about 5 wt %, based on the total weight of the components in the lubricant composition.

As described above the antioxidant, component (a), provides to the lubricant composition of the present invention the following benefit(s), for example, long life and detergency.

In preparing the lubricant composition of the present invention, a second required component (b) includes at least one base oil. In general, the base oil can be any API Group I, II, III, IV or V base oil. Examples of a Group III base oils are Nexbase 3060, Nexbase 3043 and Yubase 4. An example of a Group IV base oil is Spectrasyn 4. Examples of Group V base oils are SYNALOX 50-30B, SYNALOX 100-30B and UCON OSP-46. Examples of base oils useful in the present invention are described in Table I.

The base oil, component (b), of the lubricant composition provides several benefit(s) to the lubricant composition including, for example, the base oil provides the lubricant composition with the desired viscosity, viscosity index, and low temperature properties; and the base oil acts as a carrier fluid for the additive package.

The lubricant composition of the present invention may also include other components or additives including for example one or more of other base oils, other ADPA, other polyethersulphide, other types of anti-oxidants such as hindered phenolics, phenyl-alpha-naphthylamines or alkylated phenyl-alpha-naphthylamines and phenothiazine, and other additives such as viscosity index improvers, corrosion inhibitors, yellow metal passivators, foam control agents, extreme pressure additive, anti-wear additives, friction modifiers, pour point depressants; and dyes; and mixtures thereof.

The concentration of the optional additives added to the lubricant composition of the present invention may range generally from 0 wt % to about 25 wt % in one embodiment, from about 0.01 wt % to about 15 wt % in another embodiment, and from about 0.1 wt % to about 5 wt % in still another embodiment, based on the total weight of the components in the lubricant composition.

TABLE I

Description of Base oils

| Base Oil Product | Chemistry | Supplier |
|---|---|---|
| UCON ™ OSP-46 | Dodecanol initiated random copolymer of 1,2-propylene oxide (PO) and 1,2-butylene oxide (BO) (50/50 by wt) with a typical kinematic viscosity at 40° C. of 46 $mm^2/s$ (cSt). Its average molecular weight is 1,000 grams/mole (g/mol) and viscosity index is 164. | The Dow Chemical Company |
| SYNALOX 50-30B | Butanol initiated random copolymer of 1,2-ethylene oxide (EO) and 1,2-propylene oxide (PO) (50/50 by wt) with a typical kinematic viscosity at 40° C. of 46 $mm^2/s$ (cSt). Its average molecular weight is 1,000 g/mol and viscosity index is 211. | The Dow Chemical Company |
| SYNALOX 100-30B | Butanol initiated homo-polymer of 1,2-propylene oxide (PO) with a typical kinematic viscosity at 40° C. of 46 $mm^2/s$ (cSt). Its average molecular weight is 850 g/mol and viscosity index is 190. | The Dow Chemical Company |
| SPECTRASYN 4 | A polyalphaolefin base oil with a typical kinematic viscosity at 100° C. of 3.9 $mm^2/s$ (cSt), a typical kinematic viscosity at 40° C. of 17.2 $mm^2/s$ and a pour point of <−60° C. (ASTM D97). | Exxon Mobil Chemical |
| NEXBASE 3060 | An API (American Petroleum Institute) Group III base oil with a typical kinematic viscosity at 100° C. of 5.9 $mm^2/s$ (cSt), a typical kinematic viscosity at 40° C. of 32 $mm^2/s$ and a pour point of −15° C. (ASTM D97). | Neste |
| NEXBASE 3043 | An API (American Petroleum Institute) Group III base oil with a typical kinematic viscosity at 100° C. of 4.3 $mm^2/s$ (cSt), a typical kinematic viscosity at 40° C. of 20 $mm^2/s$ and a pour point of −18° C. (ASTM D97). | Neste |
| Yubase 4 | An API (American Petroleum Institute) Group III base oil with a typical kinematic viscosity at 100° C. of 4.2 $mm^2/s$ (cSt), a typical kinematic viscosity at 40° C. of 19.6 $mm^2/s$ and a pour point of −15° C. (ASTM D97). | SK Lubricants |

The concentration of the base oil, component (b), present in the lubricant composition of the present invention may be at about >50% by weight in one embodiment, and generally is in the range of from about >50 wt % to about 99 wt % in another embodiment, from about 70 wt % to about 98 wt % in still another embodiment, and from about 90 wt % to about 95 wt % in yet another embodiment, based on the total weight of the components in the lubricant composition.

The optional additive, component (c), may be added to the lubricant composition to provide the lubricant composition with the following benefit(s): For example, corrosion inhibitors will provide ferrous and non-ferrous corrosion inhibition functionality. Viscosity modifiers can improve the viscosity index of the composition. Solvents can provide improved low temperature properties of the lubricant composition. Demulsifiers can provide improved demulsification of the composition. Antiwear and extreme pressure additives can improve the antiwear and extreme pressure properties of the composition. Lubricity additives can improve the friction control properties of the lubricant composition.

In a broad embodiment, the process of preparing the lubricant composition of the present invention includes blending or mixing the above components (a) and (b) together to form the lubricant composition.

The process and type of equipment used to prepare the lubricant composition of the present invention includes blending or mixing of the above components in conventional mixing equipment or vessels known in the art. For example, the preparation of the lubricant composition of the present invention is achieved by blending, in known mixing equipment, components (a) and (b) and optionally (c) any other desirable additives. The preparation of the lubricant composition of the present invention, and/or any of the steps thereof, may be a batch or a continuous process.

All the above compounds of the lubricant composition are typically mixed and dispersed in a vessel at a temperature enabling the preparation of an effective lubricant composition. For example, the temperature during the mixing of the above components may be generally from about 20° C. to about 100° C. in one embodiment, and from about 25° C. to about 60° C. in another embodiment.

In one preferred embodiment, the process of preparing a lubricant composition of the present invention includes, for example, the steps of (a) adding a base oil to a vessel; (b) adding the additive package described above to the vessel to form a mixture; (c) stirring the mixture in the vessel and heating the vessel to about 50° C. for about 1 hour (hr) until the resulting composition in the vessel is clear and homogeneous; and (d) cooling the vessel and contents to ambient temperature (about 25° C.).

In another preferred embodiment, the process of preparing a lubricant composition of the present invention includes, for example, the steps of (a) adding a base oil to a vessel; (b) adding the polyether sulphide while stirring at from about 20° C. to about 50° C. until the mixture in the vessel is clear and homogeneous; (c) adding the ADPA while stirring at a temperature of from about 20° C. to about 50° C. until the resulting composition is clear and homogeneous; and (d) cooling the resultant composition to ambient temperature.

In another preferred embodiment, the process of preparing the lubricant composition of the present invention includes preparing oil soluble S-PAGs using 1,2-butylene oxide as a building block and reacting with a dithioglycol to a range of molecular weights. For example, the molecular weight of the S-PAG can be in the range of from about 250 g/mol to about 5,000 g/mol in one embodiment, from about 400 g/mol to about 2,000 g/mol in another embodiment, and from about 500 g/mol to about 1,000 g/mol in still another embodiment. The molecular weight of the S-PAG may be measured by the procedure described in ASTM D4274-16 (standard test method for testing polyurethane raw materials: Determination of Hydroxyl Numbers of Polyols).

The lubricant composition that is prepared by the above process of the present invention exhibits several unexpected and unique properties; and several improvements that the antioxidant package imparted to the lubricant composition. For example one important property of the lubricant composition can include thermo-oxidative stability.

Generally, the thermo-oxidative stability performance property of the lubricant composition can be extended by 25% or more over the control sample when the compositions are evaluated versus the modified ASTM D2893 (Method B) test described earlier.

Because of the beneficial properties exhibited by the antioxidant package and the lubricant composition or formulation, the lubricant composition of the present invention is advantageously used in applications where oils are used including for example: automobile oils such as engine oils, transmission fluids, and industrial oils such a compressor fluids, gear oils, hydraulic fluids and greases.

EXAMPLES

The following Examples and Comparative Examples further illustrate the present invention in more detail but are not to be construed to limit the scope thereof.

In the following Examples and Comparative Examples, various terms and designations were used and are explained as follows:

Irganox L57 was used in the Examples and Comparative Examples. Irganox L57 is an alkylated diphenylamine (ADPA) anti-oxidant compound and commercially available from BASF.

ASTM D7042 is used to calculate kinematic viscosity.

ASTM D2270 is used to calculate viscosity index.

ASTM D4274-05 is used to measure hydroxyl number.

General Blending Procedure

Tables I, II and III below describe compositions that were prepared according to the following procedure.

To a 1,000 mL glass beaker was added each blend component in the weight percentages shown such that the total weight of the mixture was 500 g. The mixture was stirred under mild heat (e.g., up to a temperature of 50° *C. maximum*) and the stirring yielded a clear homogeneous solution. Examples of the compositions of the present invention are labelled as "Examples" or abbreviated as "Ex"; and comparative examples are labelled as "Comparative Examples" or abbreviated as "Comp. Ex".

General Procedure 1 for Synthesis of S-PAG1A (PO Derivative of Thiodiglycol)

In this synthesis 1 procedure, 1,190 grams (g) of 2,2'-thiodiethanol is loaded into a 10,000 mL stainless steel alkoxylation reactor, equipped with a stirrer, an alkylene oxide dosing system, a temperature control system, and a means to apply a vacuum. To the 2,2'-thiodiethanol in the reactor is added 26.5 g of a 45% aqueous KOH solution as a catalyst. The reactor is closed and the air in the reactor is replaced with nitrogen. Next, the reactor is heated to 115° C. at which temperature the water present in the reaction mixture is removed (to a level of <3,000 parts per million [ppm]) by applying a vacuum to the reactor at 30 millibars (mbar) for 120 min. Once the vacuum is completed, the reactor is further heated to 130° C. At the temperature of 130° C., a total of 4,750 g propylene oxide (PO) is added to the reactor over 6 hours (hr) until a target kinematic viscosity (e.g., 46 cSt at 40° C.) is reached. Once the entire PO has been added to the reactor, the oxide feed is stopped and the reactor is kept at 130° C. for 6 hr to allow the remaining propylene oxide to react away. The resulting polyglycol is treated with magnesium silicate and filtered to remove the catalyst.

The resultant product prepared by the process above has a kinematic viscosity at 40° C. of 45.8 cSt (ASTM D7042), a kinematic viscosity at 100° C. of 6.96 cSt (ASTM D7042), a viscosity index of 109 (ASTM D2270), and a hydroxyl number of 188.0 mg KOH/g. The resultant product's practical molecular weight by hydroxyl number determination is 700 g/mol (as measured using ASTM D4274-(2016).

General Procedure 2 for Synthesis of S-PAG1B (PO Derivative of Thiodiglycol)

In this General Synthesis Procedure 2, a second polyglycol product was prepared using the same recipe and process as described in the above General Synthesis Procedure 1. The resultant product has a kinematic viscosity at 40° C. of 45.3 cSt (ASTM D7042), a kinematic viscosity at 100° C. of 7.0 cSt (ASTM D7042), a viscosity index of 112 (ASTM D2270), and a hydroxyl number of 190 mg KOH/g. The resultant product's practical molecular weight by hydroxyl number determination is 590 g/mol (as measured using ASTM D4274-(2016)).

General Procedure 3 for Synthesis of S-PAG2 (BO Derivative of Thiodiglycol)

In this General Synthesis Procedure 3, 582 g of 2,2'-thiodiethanol is loaded into a 10,000 mL stainless steel alkoxylation reactor, equipped with a stirrer, an alkylene oxide dosing system, a temperature control system and a means to apply vacuum. To the 2,2'-thiodiethanol is added 13.9 g of a 45% aqueous KOH solution as a catalyst. The reactor is closed and the air in the reactor is replaced with nitrogen. Next, the reactor is heated to 115° C. at which temperature the water present in the reaction mixture is removed (to a level of <3,000 ppm) by applying a vacuum to the reactor at 30 mbar for 120 min. Once the vacuum is completed, the reactor is further heated to 130° C. At the temperature of 130° C., a total of 2514 g 1,2 butylene oxide (BO) is added over 6 hr until a target kinematic viscosity (e.g., 46 cSt at 40° C.) is reached. Once the entire BO has been added to the reactor, the oxide feed is stopped and the reactor is kept at 130° C. for 6 hr to allow the remaining butylene oxide in the reactor to react away. The resulting polyglycol is treated with magnesium silicate and filtered to remove the catalyst.

The resultant product has a kinematic viscosity at 40° C. of 50.7 cSt (ASTM D7042), a kinematic viscosity at 100° C. of 6.80 cSt (ASTM D7042), a viscosity index of 84 (ASTM D2270), and a hydroxyl number of 179.0 mg KOH/g. The resultant product's practical molecular weight by hydroxyl number determination is 630 g/mol (as measured using ASTM D4274-(2016).

Oxidation Testing

Two methods were used. For Examples 1-10 and Comparative Examples A-F described below, the following method was used.

ASTM D2893-04 (2009), "Standard Test Method for Oxidation Characteristics of Extreme-Pressure Lubrication Oils", was used in testing the Examples and Comparative Examples herein except that the ASTM D-2893B test method was modified slightly. The two modifications made to the test method were (1) the test time and (2) the method of measuring the ageing of the lubricant test sample. For example, the test time according to the ASTM D-2893B test method is 13 days. In the examples of the present invention, a test time of up to 48 days was used. In accordance with the ASTM D-2893B test method, the ageing of the lubricant test sample is measured by the viscosity change of the fluid (lubricant) before and after the 13 days test time. In the examples of the present invention, viscosity changes were not measured; but instead, the total acid number change of the lubricant was measured. The modified ASTM D-2893B test method used is further described in more detail in the following Examples and Comparative Examples:

Examples 1-10 and Comparative Examples A-F

The lubricant compositions used in these examples are described in Table II which describes a base oil content and an anti-oxidant package content; and the results of the test performed in the examples.

The apparatus used in these examples is accurately described in the ASTM D2893 (2009) Method B. The test lubricant composition (300 mL) is placed in a borosilicate glass tube and heated to 121° C. in dry air. The method of ASTM D2893 asks for the viscosity change to be recorded after 13 days. However, in the present examples, a modified ASTM D2893 method was used, that is, tracking the ageing of the lubricant was used in the present examples since polyethers show ageing changes usually through total acid number (TAN) changes versus viscosity changes. Accordingly, the TAN was measured initially. Then, the TAN was measured after 3 days, 7 days, and 13 days; and thereafter, about every 7 days by removing a 5 mL sample from a glass tube containing the lubricant sample and using the method described in ASTM D664 (2011) to test the 5 mL sample. When the total acid number increased by >2.0 mg KOH/g above the initial value, the lubricant composition is considered to have reached an ageing threshold where the composition was deemed to be no longer useful; and the time (in days) to reach that TAN threshold was recorded. The results from testing the examples are described in Table II.

For some robust formulations (lubricant compositions), the testing of these examples was stopped before the TAN value had increased by >2 mg KOH/g. The results of these examples are noted in Table II with a greater than (>) number of days result.

TABLE II

| Example No. | Base Oil (wt %) | Anti-Oxidant Package (wt %) | Initial TAN Value (mg KOH/g) | Time to TAN Increase of 2 mg KOH/g (days) |
|---|---|---|---|---|
| Comp. Ex. A | UCON OSP-46 (99.5%) | Irganox L57 (0.5%) | 0.07 | 20 |
| Ex. 1 | UCON OSP-46 (94.5%) | S-PAG1A (5%)<br>Irganox L57 (0.5%) | 0.06 | 48 |
| Ex. 2 | UCON OSP-46 (79.5%) | S-PAG1A (20%)<br>Irganox L57 (0.5%) | 0.06 | 34 |
| Comp. Ex. B | UCON OSP-46 (99.5%) repeat | Irganox L57 (0.5%) | 0.05 | 27 |
| Ex. 3 | UCON OSP-46 (94.5%) | S-PAG1B (5%)<br>Irganox L57 (0.5%) | 0.05 | >38* |
| Ex. 4 | UCON OSP-46 (79.5%) | S-PAG1B (20%)<br>Irganox L57 (0.5%) | 0.05 | >38* |

TABLE II-continued

| Example No. | Base Oil (wt %) | Anti-Oxidant Package (wt %) | Initial TAN Value (mg KOH/g) | Time to TAN Increase of 2 mg KOH/g (days) |
|---|---|---|---|---|
| Comp. Ex. C | SYNALOX 50-30B (99.5%) | Irganox L57 (0.5%) | 0.05 | 3 |
| Ex. 5 | SYNALOX 50-30B (94.5%) | S-PAG1B (5%)<br>Irganox L57 (0.5%) | 0.05 | >38* |
| Ex. 6 | SYNALOX 50-30B (79.5%) | S-PAG1B (20%)<br>Irganox L57 (0.5%) | 0.05 | 27 |
| Comp. Ex. D | SYNALOX 100-30B (99.5%) | Irganox L57 (0.5%) | 0.05 | 20 |
| Ex. 7 | SYNALOX 100-30B (94.5%) | S-PAG1B (5%)<br>Irganox L57 (0.5%) | 0.05 | >38* |
| Ex. 8 | SYNALOX 100-30B (79.5%) | S-PAG1B (20%)<br>Irganox L57 (0.5%) | 0.05 | >38* |
| Comp. Ex. E | NEXBASE 3060 (94.5%) | UCON OSP-46 (5%)<br>Irganox L57 (0.5%) | 0.04 | 7 |
| Ex. 9 | NEXBASE 3060 (94.5%) | S-PAG2 (5%)<br>Irganox L57 (0.5%) | 0.05 | >41* |
| Comp. Ex. F | SPECTRASYN 4 (94.5%) | UCON OSP-46 (5%)<br>Irganox L57 (0.5%) | 0.04 | 20 |
| Ex. 10 | SPECTRASYN (94.5%) | S-PAG2 (5%)<br>Irganox L57 (0.5%) | 0.04 | >20* |

*TAN value increase was <2.0 mgKOH/g after the time period shown

Table II describes examples of the boost in anti-oxidant performance of an ADPA (Irganox L57) that can be achieved when used in five different base oils. The five base oils include three different polyalkylene glycols: EO/PO copolymer (Examples 5 and 6), PO homo-polymer (Examples 7 and 8) and a PO/BO copolymer (Example 1-4), a polyalphaolefin (Spectrasyn 4; Example 10) and a Group III base oil (Nexbase 3060, Example 9).

It is important to note that in the examples using hydrocarbon base oils, S-PAG2 was used with the hydrocarbon base oils (Nexbase 3060, Example 9 and Spectrasyn 4, Example 10) because S-PAG2 was soluble in these hydrocarbon base oils. However, S-PAG1A and S-PAG1B were not soluble in these hydrocarbon base oils. Therefore, for hydrocarbon base oils S-PAGs that contain butylene oxide within the structure are preferred embodiments. From the results in Table II, it can be seen that the examples conducted using the hydrocarbon base oils and S-PAG, the anti-oxidant activity of a polyether containing sulphur (S-PAG) is boosted versus a polyether without sulphur (UCON OSP-46) in a hydrocarbon base oil.

The lubricant compositions of the present invention were treated with S-PAGs at a level of 5% and 20% in the present examples. The results in Table II show that the 5% level of S-PAGs generally performed better than the 20% level of S-PAGs.

A second oxidation method was used for Examples 11-14 and Comparative Examples G-H as follows:

The method is a modification of ASTM D943 and the apparatus used is described in the method. Briefly, the test lubricant composition (300 mL) is placed in a borosilicate glass tube and heated to 95° C. with oxygen blowing through the fluid per the method. The method was conducted under dry conditions and therefore no additional water was added as the method says. The ageing of the lubricant was measured by tracking the total acid number (TAN) change. Accordingly, the TAN was measured initially. Then, the TAN was measured after 7 days, and 14 days and thereafter, about every 7 days by removing a 5 mL sample from a glass tube containing the lubricant sample and using the method described in ASTM D664 (2011) to test the 5 mL sample. When the total acid number increased by >2.0 mg KOH/g above the initial value, the lubricant composition is considered to have reached an ageing threshold where the composition was deemed to be no longer useful. The time (in days) to reach that TAN threshold was recorded. The results from testing the examples are described in Table III.

For some robust formulations (lubricant compositions), the testing of these examples was stopped before the TAN value had increased by >2 mg KOH/g. The results of these examples are noted in Table III. Some fluids did not reach their end of life and are shown with a greater than (>) number of days result.

TABLE III

| Example No. | Base Oil (wt %) | Anti-Oxidant Package (wt %) | Initial TAN Value (mg KOH/g) | TAN Value After 14 days (mg KOH/g) | Time to TAN Increase of 2 mg KOH/g (days) |
|---|---|---|---|---|---|
| Comp. Ex. G | Nexbase 3043 (99.5%) | Irganox L57 (0.5%) | 0.06 | 39.4 | 14 |
| Ex. 11 | Nexbase 3043 (99.4%) | S-PAG2 (0.1%)<br>Irganox L57 (0.5%) | 0.05 | 0.10 | >14 |
| Ex. 12 | Nexbase 3043 (99.25%) | S-PAG2 (0.25%)<br>Irganox L57 (0.5%) | 0.05 | 0.10 | >14 |
| Comp. Ex. H | Yubase 4 (99.5%) | Irganox L57 (0.5%) | 0.05 | 2.42* | 7 |
| Ex. 13 | Yubase 4 (99.4%) | S-PAG2 (0.1%)<br>Irganox L57 (0.5%) | 0.04 | 0.11 | >55(a) |

TABLE III-continued

| Example No. | Base Oil (wt %) | Anti-Oxidant Package (wt %) | Initial TAN Value (mg KOH/g) | TAN Value After 14 days (mg KOH/g) | Time to TAN Increase of 2 mg KOH/g (days) |
|---|---|---|---|---|---|
| Ex 14 | Yubase 4 (99.25%) | S-PAG-2 (0.25%) Irganox L57 (0.5%) | 0.05 | 0.11 | >55 (b) |

*After 7 days
(a)after 55 days the TAN was 0.14 mgKOH/g
(b) after 55 days the TAN was 0.14 mgKOH/g Table III shows examples of the significant improvement in oxidative stability on a hydrocarbon oil (either Nexbase 3043 or Yubase 4) that contains an ADPA anti-oxidant and very low levels of S-PAG2 (0.1 or 0.25%). In Nexbase 3043, Examples 11 and 12 show the inclusion of 0.1 and 0.25% S-PAG2 can increase the oxidation stability beyond 14 days. The reference fluid (Comparative Ex. G, no S-PAG2) shows significant aging after 14 days.

In Yubase 4, Examples 13 and 14 also show the inclusion of 0.1 and 0.25% S-PAG2 can increase the oxidation stability beyond 14 days. Even after 55 days the TAN levels were only 0.14 mgKOH/g. The reference fluid (Comparative Ex. H, no S-PAG2) shows significant ageing after 7 days. The experiments shown in Table III illustrate that even at low dosage levels of 0.1 and 0.25% of S-PAG2, a very significant boost in oxidation performance can be achieved when an ADPA is used as an anti-oxidant.

What is claimed is:

1. An antioxidant package composition comprising a combination of: (i) at least one aromatic amine, and (ii) at least one polyether sulphide derived from an alkoxylate derivative of bis(2-hydroxyethyl) sulphide, bis(2-hydroxypropyl) sulphide, bis(2-hydroxybutyl) sulphide, bis(2-hydroxypentyl) sulphide and mixtures thereof.

2. The antioxidant composition of claim 1, wherein the aromatic amine is an alkylated diphenylamine.

3. The antioxidant composition of claim 1, wherein the aromatic amine is a butylated/octylated diphenylamine.

4. The antioxidant composition of claim 1, wherein the polyether sulphide is derived from a propoxylate derivative of bis(2-hydroxyethyl) sulphide.

5. The antioxidant composition of claim 1, wherein the polyether sulphide is derived from a butoxylate derivative of bis(2-hydroxyethyl) sulphide.

6. The antioxidant composition of claim 1, wherein the concentration of the aromatic amine in the antioxidant package composition is from about 2 weight percent to about 50 weight percent.

7. The antioxidant composition of claim 1, wherein the concentration of the aromatic amine in the antioxidant package composition is from about 2 weight percent to about 10 weight percent.

8. The antioxidant composition of claim 1, wherein the concentration of the polyether sulphide in the antioxidant package composition is from about 50 weight percent to about 98 weight percent.

9. The antioxidant composition of claim 1, wherein the concentration of the polyether sulphide in the antioxidant package composition is from about 90 weight percent to about 98 weight percent.

10. The antioxidant composition of claim 1, wherein the concentration of the polyether sulphide in the antioxidant package composition is from about 10 weight percent to about 50 weight percent.

11. A lubricant composition comprising:

(a) at least one base oil, (b) at least one aromatic amine, and (c) at least one polyether sulphide derived from an alkoxylate derivative of bis(2-hydroxyethyl) sulphide, bis(2-hydroxypropyl) sulphide, bis(2-hydroxybutyl) sulphide, bis(2-hydroxypentyl) sulphide and mixtures thereof.

12. The lubricant composition of claim 11, wherein the base oil is a hydrocarbon base oil and the polyether sulphide is oil soluble.

13. The lubricant composition of claim 11, wherein the base oil is a polyalkylene glycol.

14. The lubricant composition of claim 11, wherein (a) the base oil is a polyalkylene glycol, (b) the aromatic amine is an alkylated diphenylamine, and (c) the polyether sulphide is a propoxylate derivative of bis(2-hydroxyethyl) sulphide.

15. The lubricant composition of claim 11, wherein the concentration of a combination of (b) and (c) in the lubricant composition is from about 0.1 weight percent to about 25 weight percent.

16. The lubricant composition of claim 11, wherein the concentration of the base oil in the lubricant composition is from about 70 weight percent to about 99.9 weight percent.

17. The lubricant composition of claim 11, wherein the lubricant composition has a thermo-oxidative stability property that is increased compared to the lubricant composition of claim 14 without the at least one polyether sulphide; wherein the percent increase of the thermo-oxidative stability of the lubricant is greater than about 25 percent; and the thermo-oxidative stability is measured by modified Method B of ASTM D2893.

18. A process for preparing lubricant composition comprising admixing:

(a) at least one base oil, (b) at least one aromatic amine, and (c) at least one polyether sulphide derived from an alkoxylate derivative of bis(2-hydroxyethyl) sulphide, bis(2-hydroxypropyl) sulphide, bis(2-hydroxybutyl) sulphide, bis(2-hydroxypentyl) sulphide and mixtures thereof.

19. The process of claim 18, wherein the process is carried out at a temperature of from about 25° C. to about 100° C. with stirring at from about 15 minutes to about 1 hour.

* * * * *